US010886632B2

(12) United States Patent
Hsiao et al.

(10) Patent No.: US 10,886,632 B2
(45) Date of Patent: Jan. 5, 2021

(54) ANTENNA STRUCTURE AND ELECTRONIC DEVICE

(71) Applicant: Wistron NeWeb Corp., Hsinchu (TW)

(72) Inventors: An-Ting Hsiao, Hsinchu (TW); Shang-Sian You, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/595,963

(22) Filed: Oct. 8, 2019

(65) Prior Publication Data

US 2020/0127388 A1 Apr. 23, 2020

(30) Foreign Application Priority Data

Oct. 18, 2018 (TW) ..... 107136752 A

(51) Int. Cl.

| | |
|---|---|
| ***H01Q 5/35*** | (2015.01) |
| ***H01Q 21/20*** | (2006.01) |
| ***H01Q 13/10*** | (2006.01) |
| ***H01Q 1/38*** | (2006.01) |

(52) U.S. Cl.
CPC ..... *H01Q 21/20* (2013.01); *H01Q 1/38* (2013.01); *H01Q 13/10* (2013.01)

(58) Field of Classification Search
CPC ..... H01Q 21/20; H01Q 13/10; H01Q 1/38; H01Q 5/35; H01Q 9/0428; H01Q 13/106
See application file for complete search history.

(56) References Cited

U.S. PATENT DOCUMENTS

| | | | | |
|---|---|---|---|---|
| 2,846,678 | A * | 8/1958 | Best | H01Q 21/28 343/727 |
| 5,943,016 | A * | 8/1999 | Snyder, Jr. | H01Q 1/38 343/700 MS |
| 6,292,141 | B1 * | 9/2001 | Lim | H01Q 1/40 343/700 MS |
| 8,489,162 | B1 * | 7/2013 | Dou | H01Q 13/106 455/575.7 |
| 9,105,966 | B1 * | 8/2015 | Dou | H01Q 1/243 |
| 2002/0190905 | A1 * | 12/2002 | Flint | H01Q 9/42 343/702 |

(Continued)

FOREIGN PATENT DOCUMENTS

| | | | | |
|---|---|---|---|---|
| EP | 2963736 | A1 * | 1/2016 | H01Q 21/24 |
| JP | 2008219322 | A * | 9/2008 | H01Q 21/22 |

*Primary Examiner* — Dimary S Lopez Cruz
*Assistant Examiner* — Bamidele A Jegede
(74) *Attorney, Agent, or Firm* — McClure, Qualey & Rodack, LLP

(57) ABSTRACT

An antenna structure includes a dielectric substrate, a ground plane, and a main radiation element. The main radiation element and the ground plane are disposed on two opposite surfaces of the dielectric substrate. The main radiation element has a first loop-shaped slot and a second loop-shaped slot. The first loop-shaped slot is inside the second loop-shaped slot. The first loop-shaped slot includes a first slot, a second slot, a third slot, a fourth slot, a pair of first partition slots, a pair of second partition slots, a pair of third partition slots, and a pair of fourth partition slots. The first slot, the second slot, the third slot, and the fourth slot are interleaved with the first partition slots, the second partition slots, the third partition slots, and the fourth partition slots.

20 Claims, 6 Drawing Sheets

(56) References Cited

U.S. PATENT DOCUMENTS

| | | | | |
|---|---|---|---|---|
| 2004/0233111 | A1* | 11/2004 | Desclos | H01Q 9/28 343/700 MS |
| 2005/0093752 | A1* | 5/2005 | Cheng | H01Q 1/2266 343/702 |
| 2007/0120740 | A1* | 5/2007 | Iellici | H01Q 5/40 343/700 MS |
| 2007/0268186 | A1* | 11/2007 | Liu | H01Q 9/42 343/700 MS |
| 2008/0106473 | A1* | 5/2008 | Chung | H01Q 1/38 343/700 MS |
| 2008/0204340 | A1* | 8/2008 | Kim | H01Q 1/243 343/770 |
| 2011/0109515 | A1* | 5/2011 | Rao | H01Q 9/0421 343/702 |
| 2012/0218163 | A1* | 8/2012 | Wong | H01Q 5/378 343/843 |
| 2013/0342409 | A1* | 12/2013 | Tatarnikov | H01Q 7/00 343/729 |
| 2016/0220828 | A1* | 8/2016 | Yan Poon | A61N 1/36125 |
| 2017/0033461 | A1* | 2/2017 | Mohajer Jasebi | H01Q 1/2291 |
| 2017/0037838 | A1* | 2/2017 | Hirata | F04B 17/003 |

* cited by examiner

ANTENNA STRUCTURE AND ELECTRONIC DEVICE

CROSS REFERENCE TO RELATED APPLICATIONS

This application claims priority of Taiwan Patent Application No. 107136752 filed on Oct. 18, 2018, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna that is used for signal reception and transmission has insufficient bandwidth, the communication quality of the relevant mobile device will suffer. Accordingly, it has become a critical challenge for antenna designers to design a wideband antenna element that is small in size.

BRIEF SUMMARY OF THE INVENTION

In an exemplary embodiment, the invention is directed to an antenna structure including a dielectric substrate, a ground plane, and a main radiation element. The dielectric substrate has a first surface and a second surface which are opposite to each other. The ground plane is disposed on the second surface of the dielectric substrate. The main radiation element is disposed on the first surface of the dielectric substrate. The main radiation element has a first loop-shaped slot and a second loop-shaped slot. The first loop-shaped slot is positioned inside the second loop-shaped slot. The first loop-shaped slot includes a first slot, a second slot, a third slot, a fourth slot, a pair of first partition slots, a pair of second partition slots, a pair of third partition slots, and a pair of fourth partition slots. The first slot, the second slot, the third slot, and the fourth slot are interleaved with the first partition slots, the second partition slots, the third partition slots, and the fourth partition slots. The first feeding point of the antenna structure is positioned between the first partition slots. The second feeding point of the antenna structure is positioned between the second partition slots.

In some embodiments, the first slot, the second slot, the third slot, and the fourth slot are separate from each other.

The first slot, the second slot, the third slot, and the fourth slot are all arranged on the first circumference of a concentric circle.

In some embodiments, the first slot corresponds to a first central angle, the second slot corresponds to a second central angle, the third slot corresponds to a third central angle, and the fourth slot corresponds to a fourth central angle. The first central angle, the second central angle, the third central angle, and the fourth central angle are all between 70 and 89.5 degrees.

In some embodiments, the second loop-shaped slot is arranged on the second circumference of the concentric circle. The length of the second circumference is longer than the length of the first circumference.

In some embodiments, one of the first partition slots is connected to the fourth slot, and the other first partition slot is connected to the first slot. One of the second partition slots is connected to the first slot, and the other second partition slot is connected to the second slot. One of the third partition slots is connected to the second slot, and the other third partition slot is connected to the third slot. One of the fourth partition slots is connected to the third slot, and the other fourth partition slot is connected to the fourth slot.

In some embodiments, a first angle is formed between the first partition slots, a second angle is formed between the second partition slots, a third angle is formed between the third partition slots, and a fourth angle is formed between the fourth partition slots. The first angle, the second angle, the third angle, and the fourth angle are all between 0.5 and 20 degrees.

In some embodiments, the main radiation element is divided into a central radiation element, a loop-shaped radiation element, and a grounding radiation element by the first loop-shaped slot and the second loop-shaped slot. The central radiation element is at least partially coupled to the loop-shaped radiation element. The loop-shaped radiation element is separate from the grounding radiation element.

In some embodiments, the central radiation element is positioned inside the first loop-shaped slot. The loop-shaped radiation element is positioned between the first loop-shaped slot and the second loop-shaped slot. The grounding radiation element is positioned outside the second loop-shaped slot.

In some embodiments, the antenna structure covers a first frequency band and a second frequency band. The first frequency band is from 1166 MHz to 1186 MHz or from 1217 MHz to 1237 MHz. The second frequency band is from 1565 MHz to 1585 MHz. The loop-shaped radiation element is excited to generate the first frequency band. The central radiation element is excited to generate the second frequency band.

In some embodiments, the distance between the second loop-shaped slot and the first loop-shaped slot is from $1/140$ to $1/40$ wavelength of the first frequency band.

In some embodiments, the width of the second loop-shaped slot and the width of the first loop-shaped slot are both from $1/350$ to $1/250$ wavelength of the first frequency band.

In some embodiments, the dielectric substrate includes a first layer and a second layer which are parallel to each other. The first layer is adjacent to the first surface of the dielectric substrate. The second layer is adjacent to the second surface of the dielectric substrate. The first dielectric constant of the first layer is different from the second dielectric constant of the second layer.

In some embodiments, the first dielectric constant is at least 3 times higher than the second dielectric constant.

In some embodiments, the area of the ground plane is greater than the area of the main radiation element. The main radiation element has a vertical projection on the second surface of the dielectric substrate, and the whole vertical projection is inside the ground plane.

In some embodiments, the antenna structure further includes a parasitic radiation element. The parasitic radiation element is floating and is adjacent to the main radiation element.

In some embodiments, the parasitic radiation element has a central slot, a third loop-shaped slot, and a fourth loop-shaped slot. The third loop-shaped slot is positioned between the central slot and the fourth loop-shaped slot.

In some embodiments, the first partition slots are further respectively connected to a pair of first additional slots which extend away from each other. The second partition slots are further respectively connected to a pair of second additional slots which extend away from each other. The third partition slots are further respectively connected to a pair of third additional slots which extend away from each other. The fourth partition slots are further respectively connected to a pair of fourth additional slots which extend away from each other.

In some embodiments, the first partition slots are further respectively connected to a pair of first crossing slots. The second partition slots are further respectively connected to a pair of second crossing slots. The third partition slots are further respectively connected to a pair of third crossing slots. The fourth partition slots are further respectively connected to a pair of fourth crossing slots.

In some embodiments, a third feeding point of the antenna structure is positioned between the third partition slots, and a fourth feeding point of the antenna structure is positioned between the fourth partition slots.

In another exemplary embodiment, the invention is directed to an electronic device including a housing and an antenna structure. The antenna structure is disposed inside the housing. The antenna structure includes a dielectric substrate, a ground plane, and a main radiation element. The dielectric substrate has a first surface and a second surface which are opposite to each other. The ground plane is disposed on the second surface of the dielectric substrate. The main radiation element is disposed on the first surface of the dielectric substrate. The main radiation element has a first loop-shaped slot and a second loop-shaped slot. The first loop-shaped slot is positioned inside the second loop-shaped slot. The first loop-shaped slot includes a first slot, a second slot, a third slot, a fourth slot, a pair of first partition slots, a pair of second partition slots, a pair of third partition slots, and a pair of fourth partition slots. The first slot, the second slot, the third slot, and the fourth slot are interleaved with the first partition slots, the second partition slots, the third partition slots, and the fourth partition slots. The first feeding point of the antenna structure is positioned between the first partition slots. The second feeding point of the antenna structure is positioned between the second partition slots.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
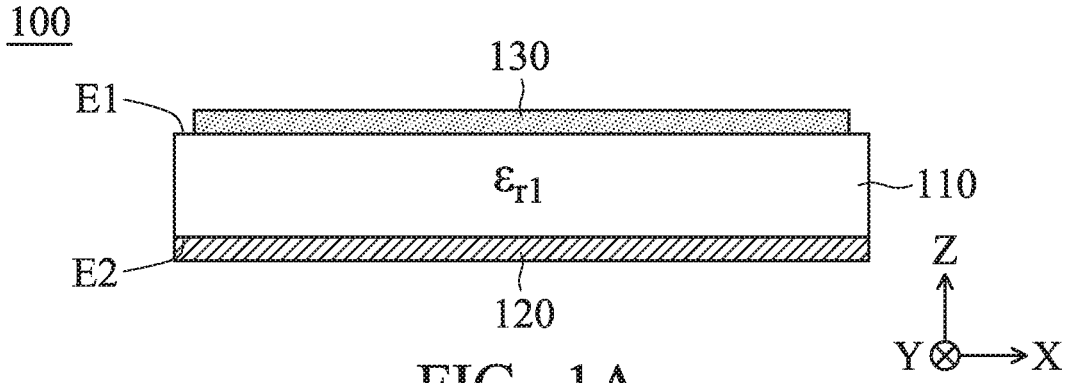
FIG. 1A is a side view of an antenna structure according to an embodiment of the invention.

FIG. 1A is a side view of an antenna structure 100 according to an embodiment of the invention. As shown in FIG. 1A, the antenna structure 100 includes a dielectric substrate 110, a ground plane 120, and a main radiation element 130. The dielectric substrate 110 is made of a nonconductive material, and it has a first dielectric constant $\varepsilon_{r1}$, which is greater than or equal to 1. For example, the dielectric substrate 110 may be an FR4 (Flame Retardant 4) substrate, a PCB (Printed Circuit Board), a FCB (Flexible Circuit Board), or a compound circuit board. The main radiation element 130 and the ground plane 120 may both be planar structures made of metal materials. The dielectric substrate 110 has a first surface E1 and a second surface E2, which are opposite to each other and parallel to each other. The main radiation element 130 is disposed on the first surface E1 of the dielectric substrate 110. The ground plane 120 is disposed on the second surface E2 of the dielectric substrate 110. In some embodiments, the area of the ground plane 120 is greater than the area of the main radiation element 130. Thus, the main radiation element 130 has a vertical projection on the second surface E2 of the dielectric substrate 110, and the whole vertical projection is inside the ground plane 120.

Figure 1B:
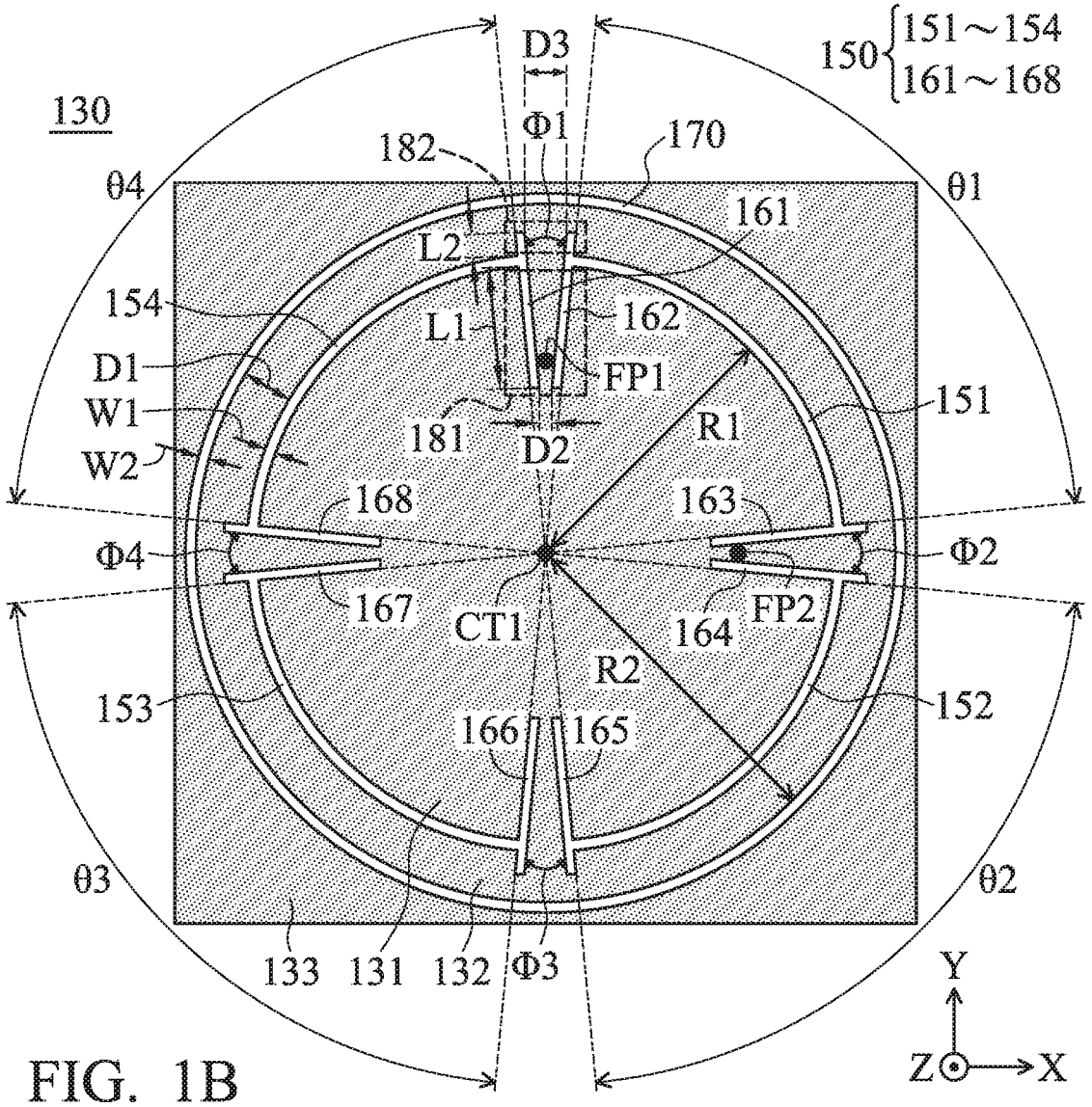
FIG. 1B is a top view of an antenna structure according to an embodiment of the invention.

FIG. 1B is a top view of the antenna structure 100 according to an embodiment of the invention. Please refer to FIG. 1A and FIG. 1B together to understand the invention.

The main radiation element 130 may substantially have a square shape or a rectangular shape. The main radiation element 130 has a first loop-shaped slot 150 and a second loop-shaped slot 170. The first loop-shaped slot 150 is completely positioned inside the second loop-shaped slot 170. The first loop-shaped slot 150 includes a first slot 151, a second slot 152, a third slot 153, a fourth slot 154, a pair of first partition slots 161 and 162, a pair of second partition slots 163 and 164, a pair of third partition slots 165 and 166, and a pair of fourth partition slots 167 and 168. The first slot 151, the second slot 152, the third slot 153, and the fourth slot 154 are interleaved with the first partition slots 161 and 162, the second partition slots 163 and 164, the third partition slots 165 and 166, and the fourth partition slots 167 and 168.

The main radiation element 130 is divided into a central radiation element 131, a loop-shaped radiation element 132, and a grounding radiation element 133 by the first loop-shaped slot 150 and the second loop-shaped slot 170. Specifically, the central radiation element 131 is at least partially coupled to the loop-shaped radiation element 132, and the loop-shaped radiation element 132 is completely separate from the grounding radiation element 133. The central radiation element 131 is positioned inside the first loop-shaped slot 150. The loop-shaped radiation element 132 is positioned between the first loop-shaped slot 150 and the second loop-shaped slot 170. The grounding radiation element 133 is positioned outside the second loop-shaped slot 170. In some embodiments, the grounding radiation element 133 is floating. In alternative embodiments, the grounding radiation element 133 is coupled through one or more conductive via elements (not shown) to the ground plane 120, and the aforementioned conductive via elements penetrate the dielectric substrate 110.

In some embodiments, the first slot 151, the second slot 152, the third slot 153, and the fourth slot 154 are separate from each other, and are all arranged on the first circumference of a concentric circle. The second loop-shaped slot 170 is arranged on the second circumference of the concentric circle. The radius R1 of the first circumference is shorter than the radius R2 of the second circumference, and the length of the second circumference is longer than the length of the first circumference. Specifically, each of the first slot 151, the second slot 152, the third slot 153, and the fourth slot 154 may substantially have an arc-shape. According to the center CT of the concentric circle, the first slot 151 corresponds to a first central angle θ1, the second slot 152 corresponds to a second central angle θ2, the third slot 153 corresponds to a third central angle θ3, and the fourth slot 154 corresponds to a fourth central angle θ4. The first central angle θ1, the second central angle θ2, the third central angle θ3, and the fourth central angle θ4 may be the same or different. However, the invention is not limited thereto. In alternative embodiments, the first slot 151, the second slot 152, the third slot 153, and the fourth slot 154 are all arranged on the periphery of a first geometric pattern, and the second loop-shaped slot 170 is arranged on the periphery of a second geometric pattern. The first geometric pattern and the second geometric pattern may have a variety of possible shapes, such as square, rectangular, hexagonal, or elliptical.

Each pair of the aforementioned partition slots includes two separate straight-line-shaped slots, which may or may not be parallel to each other. A first angle Φ1 is formed between the first partition slots 161 and 162. A second angle Φ2 is formed between the second partition slots 163 and 164. A third angle Φ3 is formed between the third partition slots 165 and 166. A fourth angle Φ4 is formed between the fourth partition slots 167 and 168. The first angle Φ1, the second angle Φ2, the third angle Φ3, and the fourth angle Φ4 may be the same or different. Specifically, the first partition slot 161 is connected to an end of the fourth slot 154 and is at least partially perpendicular to the fourth slot 154, the first partition slot 162 is connected to an end of the first slot 151 and is at least partially perpendicular to the first slot 151, the second partition slot 163 is connected to the other end of the first slot 151 and is at least partially perpendicular to the first slot 151, the second partition slot 164 is connected to an end of the second slot 152 and is at least partially perpendicular to the second slot 152, the third partition slot 165 is connected to the other end of the second slot 152 and is at least partially perpendicular to the second slot 152, the third partition slot 166 is connected to an end of the third slot 153 and is at least partially perpendicular to the third slot 153, the fourth partition slot 167 is connected to the other end of the third slot 153 and is at least partially perpendicular to the third slot 153, and the fourth partition slot 168 is connected to the other end of the fourth slot 154 and is at least partially perpendicular to the fourth slot 154.

In some embodiments, the first partition slots 161 and 162 include a first portion 181 and a second portion 182. The first portion 181 is equivalent to a portion of the first partition slots 161 and 162 extending into the central radiation element 131. The second portion 182 is equivalent to another portion of the first partition slots 161 and 162 extending into the loop-shaped radiation element 132. That is, the first portion 181 and the second portion 182 of the first partition slots 161 and 162 may extend in opposite directions. The length L1 of the first portion 181 of the first partition slots 161 and 162 may be longer than the length L2 of the second portion 182 of the first partition slots 161 and 162 (e.g., length L1 may be at least 5 times longer than length L2). In addition, the distance D2 relative to the first portion 181 of the first partition slots 161 and 162 (e.g., the distance D2 between two closed ends of the first portion 181) may be shorter than or equal to the distance D3 relative to the second portion 182 of the first partition slots 161 and 162 (e.g., the distance D3 between two closed ends of the second portion 182). According to practical measurements, this design can improve the low-frequency impedance matching of the antenna structure 100. It should be understood that although only the first partition slots 161 and 162 are exemplary herein, the second partition slots 163 and 164, the third partition slots 165 and 166, and the fourth partition slots 167 and 168 may have structures that are similar to those of the first partition slots 161 and 162, and they will not illustrated again.

The first feeding point FP1 of the antenna structure 100 is either positioned between the first partition slots 161 and 162, or it is positioned between two extension lines of the first partition slots 161 and 162. The second feeding point FP2 of the antenna structure 100 is either positioned between the second partition slots 163 and 164, or it is positioned between two extension lines of the second partition slots 163 and 164. In some embodiments, the difference in the feeding phase between the first feeding point FP1 and the second feeding point FP2 is substantially equal to 90 degrees, so that the antenna structure 100 can generate a CP (Circularly-Polarized) radiation pattern. According to practical measurements, the above slot arrangement can effectively increase the isolation between the first feeding point FP1 and the second feeding point FP2.

In some embodiments, the antenna structure 100 covers a first frequency band and a second frequency band. The first frequency band is from 1166 MHz to 1186 MHz or from 1217 MHz to 1237 MHz. The second frequency band is from 1565 MHz to 1585 MHz. According to antenna theory, the loop-shaped radiation element 132 is excited to generate a first frequency band, and the central radiation element 131 is excited to generate a second frequency band. Accordingly, the antenna structure 100 can support at least the dual-band operations of GPS (Global Positioning System).

Figure 2:
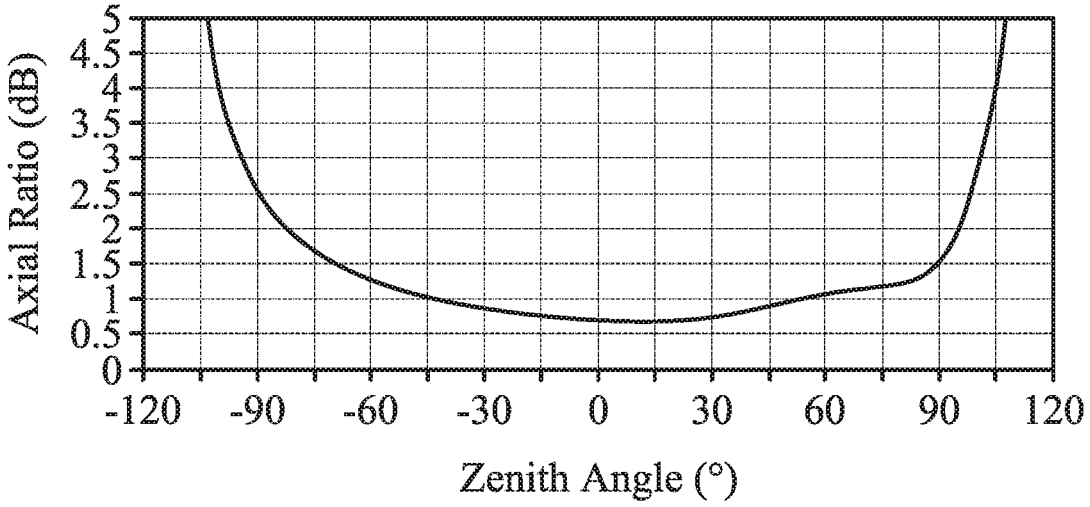
FIG. 2 is a diagram of axial ratio of an antenna structure according to an embodiment of the invention.

FIG. 2 is a diagram of axial ratio of the antenna structure 100 according to an embodiment of the invention. The horizontal axis represents the zenith angle of the antenna structure 100 (+Z-axis is set as the 0 degree), and the vertical axis represents the axial ratio of the antenna structure 100. According to the measurement of FIG. 2, if the axial ratio equal to 3 dB is used as a criterion, the beam width of the antenna structure 100 can be about 200 degrees, and it can meet the requirement of practical application of general CP antennas.

In some embodiments, the element sizes of the antenna structure 100 are as follows. The distance D1 between the second loop-shaped slot 170 and the first loop-shaped slot 150 (or the distance D1 between the second loop-shaped slot 170 and any of the first slot 151, the second slot 152, the third slot 153, and the fourth slot 154) may be from 1/140 to 1/40 wavelength of the first frequency band (λ/140~λ/40). The width W2 of the second loop-shaped slot 170 and the width W1 of the first loop-shaped slot 150 (or the width W1 of any of the first slot 151, the second slot 152, the third slot 153, and the fourth slot 154) may both be from 1/350 to 1/250 wavelength of the first frequency band (λ/350~λ/250). The first central angle θ1, the second central angle θ2, the third central angle θ3, and the fourth central angle θ4 may all be from 70 to 89.5 degrees. If the first central angle θ1, the second central angle θ2, the third central angle θ3, and the fourth central angle θ4 become larger, the operation bandwidth of the first frequency band of the antenna structure 100 can be increased. The first angle Φ1, the second angle Φ2, the third angle Φ3, and the fourth angle Φ4 may all be from 0.5 to 20 degrees. If the first angle Φ1, the second angle Φ2, the third angle Φ3, and the fourth angle Φ4 become larger, the operation bandwidth of the second frequency band of the antenna structure 100 can be increased. The radius R1 from the center CT1 to the outer edge of the central radiation element 131 may be from 0.07 to 0.1 wavelength of the first frequency band (0.07λ~0.1λ). The radius R2 from the center CT1 to the outer edge of the loop-shaped radiation element 132 may be from 0.09 to 0.125 wavelength of the first frequency band (0.09λ~0.125λ). The length L1 of the first portion 181 of the first partition slots 161 and 162 may be from 0.035 to 0.057 wavelength of the first frequency band (0.035λ~0.057λ), and it is used to fine-tune the impedance matching of the second frequency band of the antenna structure 100. The length L2 of the second portion 182 of the first partition slots 161 and 162 may be from 0.005 to 0.018 wavelength of the first frequency band (0.005λ~0.018λ), and it is used to fine-tune the impedance matching of the first frequency band of the antenna structure 100. The above ranges of element sizes are calculated and obtained according to many experiment results, and they help to optimize the operation bandwidth and the CP beam width of the antenna structure 100.

Figure 3:
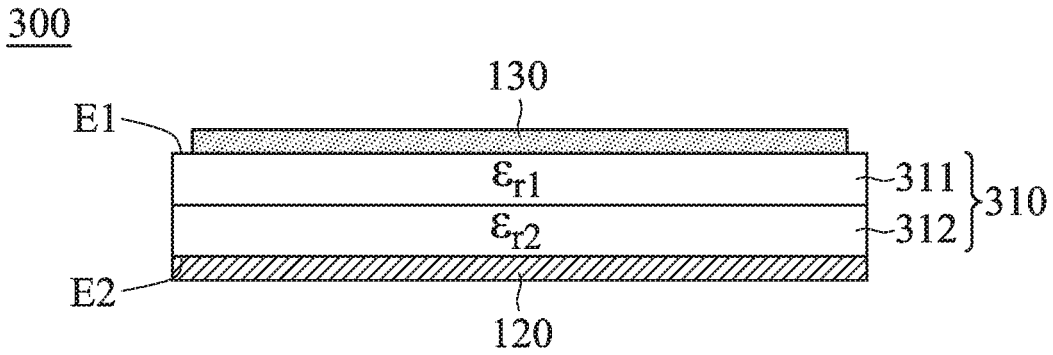
FIG. 3 is a side view of an antenna structure according to another embodiment of the invention.

FIG. 3 is a side view of an antenna structure 300 according to another embodiment of the invention. FIG. 3 is similar to FIG. 1A. In the embodiment of FIG. 3, a dielectric substrate 310 of the antenna structure 300 includes a first layer 311 and a second layer 312, which are parallel to each other. The first layer 311 is adjacent to a first surface E1 of the dielectric substrate 310. The second layer 312 is adjacent to a second surface E2 of the dielectric substrate 310. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0). The first dielectric constant $\varepsilon_{r1}$ of the first layer 311 is different from the second dielectric constant $\varepsilon_{r2}$ of the second layer 312. For example, the first dielectric constant $\varepsilon_{r1}$ may be greater than the second dielectric constant $\varepsilon_{r2}$. In some embodiments, the first dielectric constant $\varepsilon_{r1}$ is 3 to 5 times higher than the second dielectric constant $\varepsilon_{r2}$. According to the practical measurement, this design can help increase the operation bandwidth of the antenna structure 300. Other features of the antenna structure 300 of FIG. 3 are similar to those of the antenna structure 100 of FIG. 1A and FIG. 1B. Therefore, the two embodiments can achieve similar levels of performance.

Figure 4A:
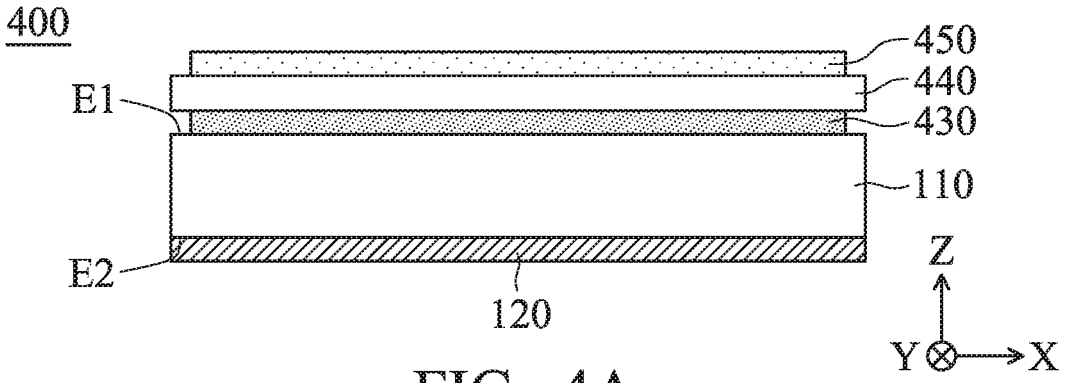
FIG. 4A is a side view of an antenna structure according to another embodiment of the invention.

FIG. 4A is a side view of an antenna structure 400 according to another embodiment of the invention. FIG. 4A is similar to FIG. 1A. In the embodiment of FIG. 4A, the antenna structure 400 further includes a parasitic radiation element 450, which is a planar structure made of a metal material. The parasitic radiation element 450 is floating and is adjacent to a main radiation element 430 of the antenna structure 400. In some embodiments, the antenna structure 400 further includes a nonconductive supporting element 440, which is disposed on the main radiation element 430 and is configured to support and fix the parasitic radiation element 450.

Figure 4B:
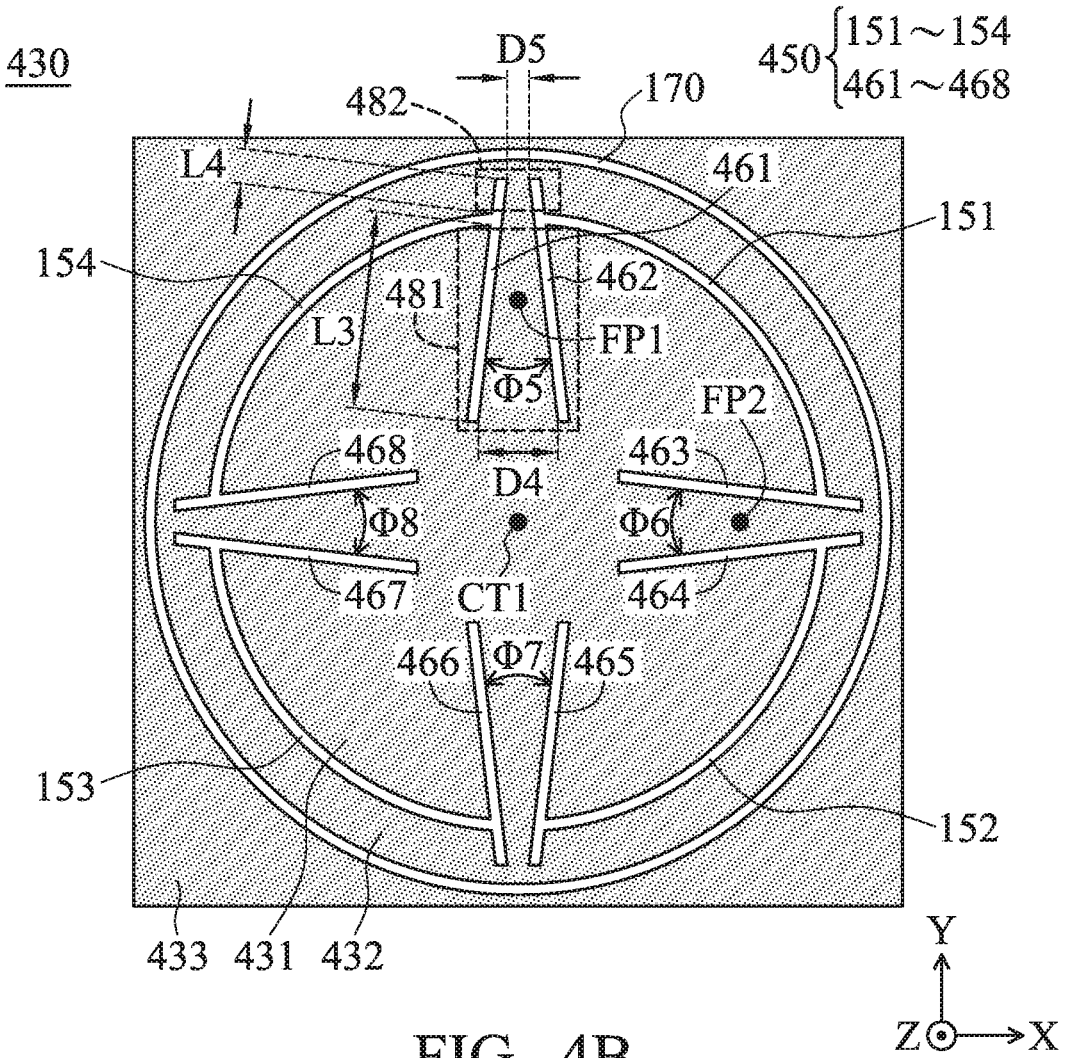
FIG. 4B is a top view of a main radiation element according to another embodiment of the invention.

FIG. 4B is a top view of the main radiation element 430 according to another embodiment of the invention. In the embodiment of FIG. 4B, the main radiation element 430 has a first loop-shaped slot 450 and a second loop-shaped slot 170. The main radiation element 430 is divided into a central radiation element 431, a loop-shaped radiation element 432, and a grounding radiation element 433 by the first loop-shaped slot 450 and the second loop-shaped slot 170. The first loop-shaped slot 450 includes a first slot 151, a second slot 152, a third slot 153, a fourth slot 154, a pair of first partition slots 461 and 462, a pair of second partition slots 463 and 464, a pair of third partition slots 465 and 466, and a pair of fourth partition slots 467 and 468. Each pair of the aforementioned partition slots includes two separate straight-line-shaped slots, which may or may not be parallel to each other. It should be noted that if the distance between each pair of partition slots of the main radiation element 130 of FIG. 1B is relatively long at the outer side and relatively short at the inner side, the distance between each pair of partition slots of the main radiation element 430 of FIG. 4B may be relatively short at the outer side and relatively long at the inner side. A first angle Φ5 is formed between the first partition slots 461 and 462. A second angle Φ6 is formed between the second partition slots 463 and 464. A third angle Φ7 is formed between the third partition slots 465 and 466. A fourth angle Φ8 is formed between the fourth partition slots 467 and 468. The first angle Φ5, the second angle Φ6, the third angle Φ7, and the fourth angle Φ8 may be the same or different. For example, the first angle Φ5, the second angle Φ6, the third angle Φ7, and the fourth angle Φ8 may all be from 0.5 to 20 degrees. In some embodiments, the first partition slots 461 and 462 include a first portion 481 and a second portion 482. The first portion 481 is equivalent to a portion of the first partition slots 461 and 462 extending into the central radiation element 431. The second portion 482 is equivalent to another portion of the first partition slots 461 and 462 extending into the loop-shaped radiation element 432. The length L3 of the first portion 481 of the first partition slots 461 and 462 may be longer than the length L4 of the second portion 482 of the first partition slots 461 and 462 (e.g., length L3 may be at least 5 times longer than length L4). The distance D4 relative to the first portion 481 of the first partition slots 461 and 462 (e.g., the distance D4 between two closed ends of the first portion 481) may be longer than or equal to the distance D5 relative to the second portion 482 of the first partition slots 461 and 462 (e.g., the distance D5 between two closed ends of the second portion 482). According to practical measurements, this design can improve the high-frequency impedance matching of the antenna structure 400. It should be understood that although only the first partition slots 461 and 462 are exemplary herein, the second partition slots 463 and 464, the third partition slots 465 and 466, and the fourth partition slots 467 and 468 may have structures that are similar to those of the first partition slots 461 and 462, and they will not illustrated again.

Figure 4C:
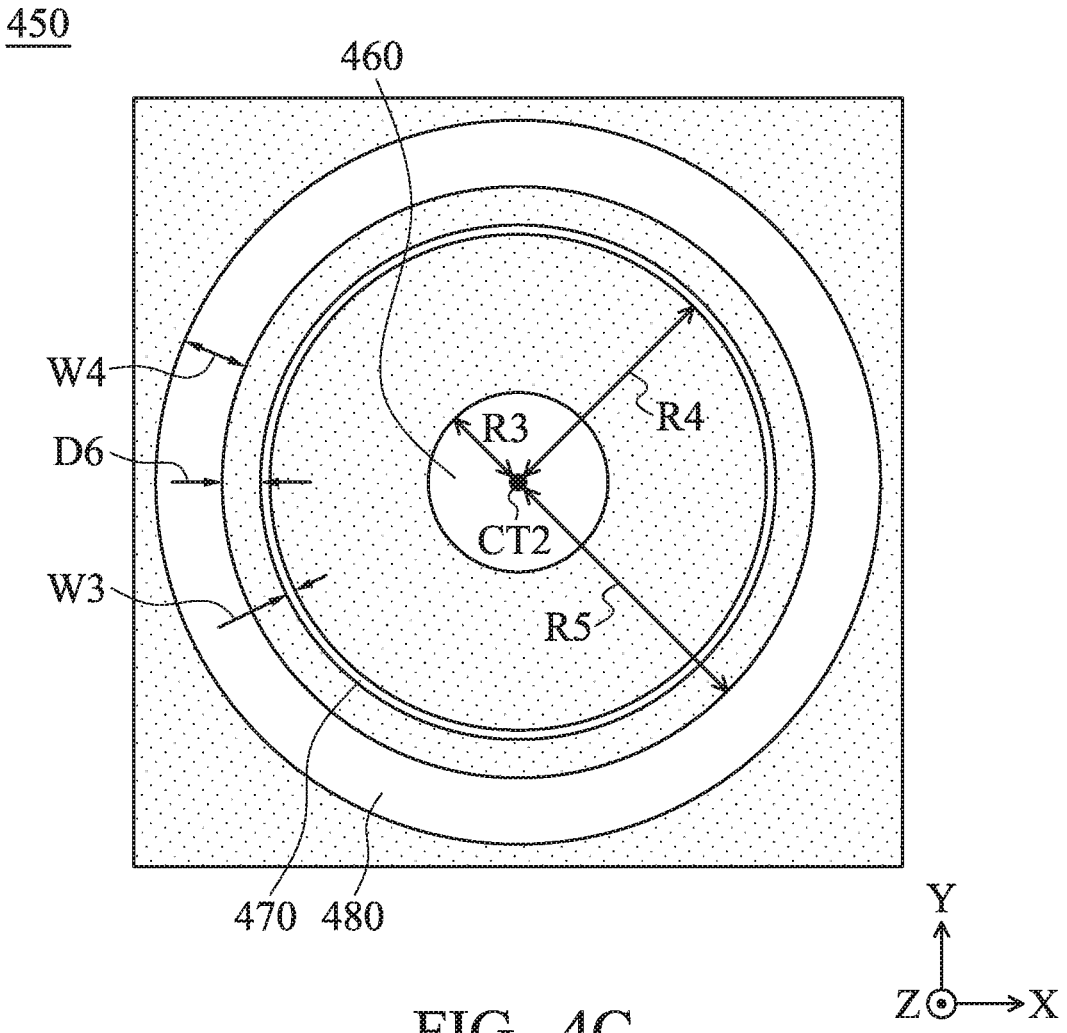
FIG. 4C is a top view of a parasitic radiation element according to another embodiment of the invention.

FIG. 4C is a top view of the parasitic radiation element 450 according to another embodiment of the invention. The parasitic radiation element 450 may substantially have a square shape or a rectangular shape. The area of the parasitic radiation element 450 may be substantially equal to the area of the main radiation element 430. In the embodiment of FIG. 4C, the parasitic radiation element 450 has a central slot 460, a third loop-shaped slot 470, and a fourth loop-shaped slot 480. The third loop-shaped slot 470 is positioned between the central slot 460 and the fourth loop-shaped slot 480. The central slot 460, the third loop-shaped slot 470, and the fourth loop-shaped slot 480 are completely separate from each other. Specifically, the central slot 460 has a third circumference and is positioned at the center CT2 of another concentric circle, the third loop-shaped slot 470 is arranged on a fourth circumference of the concentric circle, and the fourth loop-shaped slot 480 is arranged on a fifth circumference of the concentric circle. The radius R3 of the third circumference is shorter than the radius R4 of the fourth circumference, and the radius R4 of the fourth circumference is shorter than the radius R5 of the fifth circumference. With respect to the element sizes, the width W4 of the fourth loop-shaped slot 480 is much longer than the width W3 of the third loop-shaped slot 470 (e.g., width W4 may be at least 5 times wider than width W3). The radius R3 from the center CT2 to the outer edge of the central slot 460 may be from 0.032 to 0.052 wavelength of the first frequency band of the antenna structure 400 (0.032λ~0.052λ). The radius R4 from the center CT2 to the inner edge of the third loop-shaped slot 470 may be from 0.08 to 0.12 wavelength of the first frequency band of the antenna structure 400 (0.08λ~0.12λ). The radius R5 from the center CT2 to the inner edge of the fourth loop-shaped slot 480 may be from 0.09 to 0.125 wavelength of the first frequency band of the antenna structure 400 (0.09λ~0.125λ). The distance D6 between the third loop-shaped slot 470 and the fourth loop-shaped slot 480 may be from 0.0008 to 0.001 wavelength of the first frequency band of the antenna structure 400 (0.0008λ~0.001λ). According to practical measurements, a mutual coupling effect is induced between the parasitic radiation element 450 and the main radiation element 430, and it can increase the operation bandwidth of the antenna structure 400. Other features of the antenna structure 400 of FIG. 4A, FIG. 4B, and FIG. 4C are similar to those of the antenna structure 100 of FIG. 1A and FIG. 1B. Therefore, the two embodiments can achieve similar levels of performance.

Figure 5A:
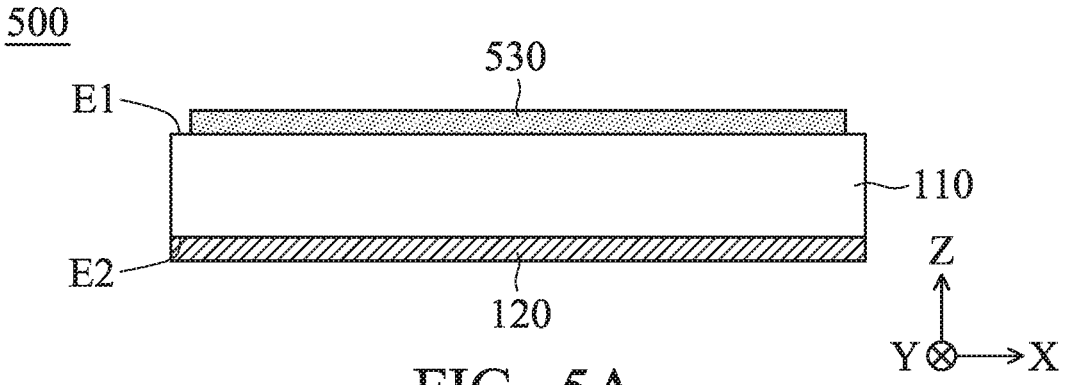
FIG. 5A is a side view of an antenna structure according to another embodiment of the invention.
Figure 5B:
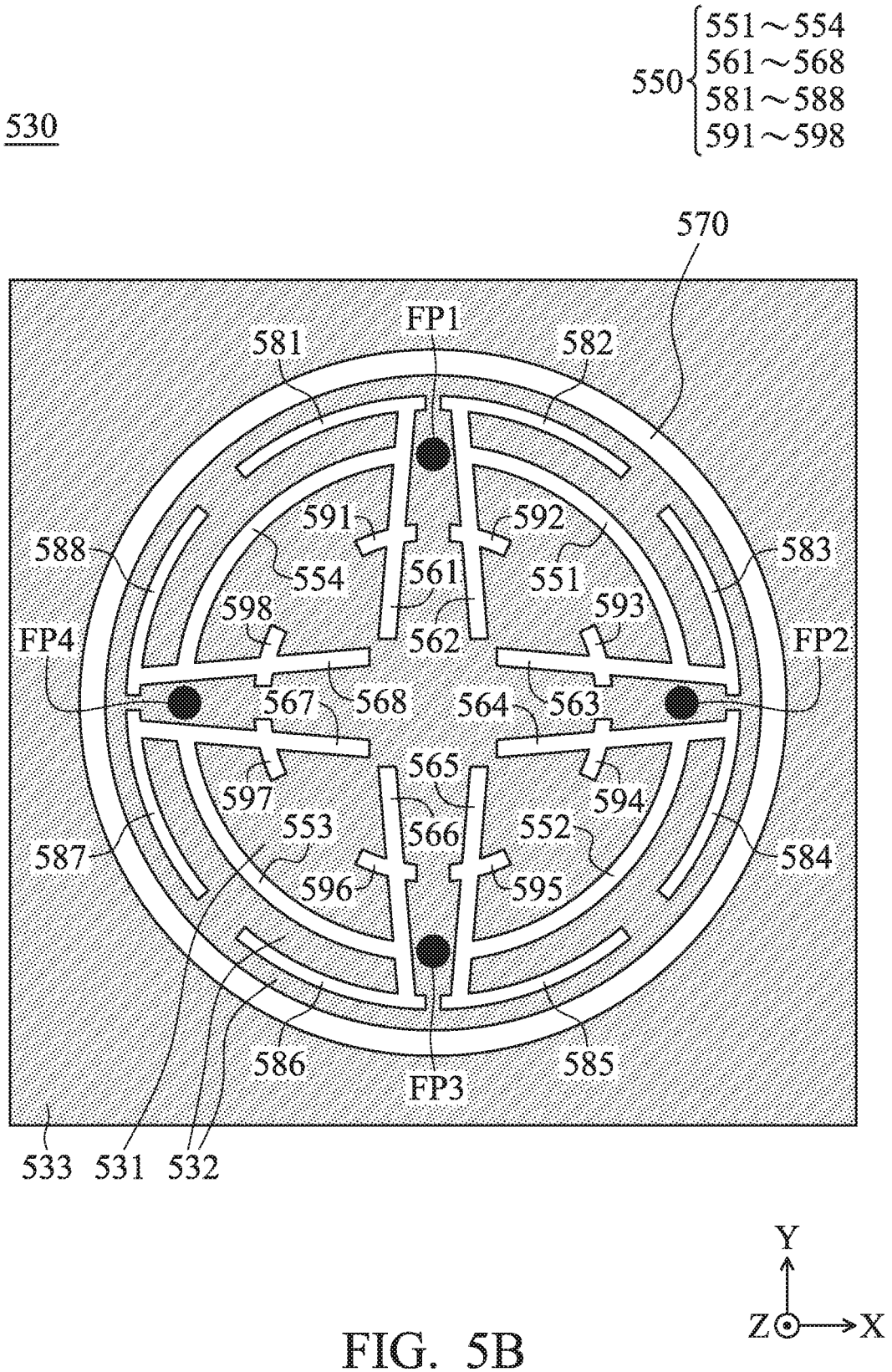
FIG. 5B is a top view of a main radiation element according to another embodiment of the invention.

FIG. 5A is a side view of an antenna structure 500 according to another embodiment of the invention. In the embodiment of FIG. 5A, a main radiation element 530 of the antenna structure 500 is disposed on a first surface E1 of a dielectric substrate 110. FIG. 5B is a top view of the main radiation element 530 according to another embodiment of the invention. In the embodiment of FIG. 5B, the main radiation element 530 has a first loop-shaped slot 550 and a second loop-shaped slot 570. The main radiation element 530 is divided into a central radiation element 531, a loop-shaped radiation element 532, and a grounding radiation element 533 by the first loop-shaped slot 550 and the second loop-shaped slot 570. The first loop-shaped slot 550 includes a first slot 551, a second slot 552, a third slot 553, a fourth slot 554, a pair of first partition slots 561 and 562, a pair of second partition slots 563 and 564, a pair of third partition slots 565 and 566, a pair of fourth partition slots 567 and 568, a pair of first additional slots 581 and 582, a pair of second additional slots 583 and 584, a pair of third additional slots 585 and 586, a pair of fourth additional slots 587 and 588, a pair of first crossing slots 591 and 592, a pair of second crossing slots 593 and 594, a pair of third crossing slots 595 and 596, and a pair of fourth crossing slots 597 and 598.

A first feeding point FP1 of the antenna structure 500 is positioned between the first partition slots 561 and 562. A second feeding point FP2 of the antenna structure 500 is positioned between the second partition slots 563 and 564. A third feeding point FP3 of the antenna structure 500 is positioned between the third partition slots 565 and 566. A fourth feeding point FP4 of the antenna structure 500 is positioned between the fourth partition slots 567 and 568. In some embodiments, the difference in the feeding phase between any two adjacent feeding points from among the first feeding point FP1, the second feeding point FP2, the third feeding point FP3, and the fourth feeding point FP4 is substantially equal to 90 degrees, so that the antenna structure 500 can generate a CP radiation pattern. For example, the feeding phase of the first feeding point FP1 may be equal to about 0 degrees, the feeding phase of the second feeding point FP2 may be equal to about 90 degrees, the feeding phase of the third feeding point FP3 may be equal to about 180 degrees, and the feeding phase of the fourth feeding point FP4 may be equal to about 270 degrees, but they are not limited thereto. According to practical measurements, the above slot arrangement can effectively increase the isolation between the first feeding point FP1, the second feeding point FP2, the third feeding point FP3, and the fourth feeding point FP4. Furthermore, the CP characteristics of the antenna structure 500 can be enhanced by using more feeding points to excite the antenna structure 500.

Each pair of the aforementioned additional slots includes two separate relatively long arc-shaped slots. The first additional slot 581 is connected to an end of the first partition slot 561. The first additional slot 582 is connected to an end of the first partition slot 562. The two closed ends of the first additional slots 581 and 582 extend away from each other. The second additional slot 583 is connected to an end of the second partition slot 563. The second additional slot 584 is connected to an end of the second partition slot 564. The two closed ends of the second additional slots 583 and 584 extend away from each other. The third additional slot 585 is connected to an end of the third partition slot 565. The third additional slot 586 is connected to an end of the third partition slot 566. The two closed ends of the third additional slots 585 and 586 extend away from each other. The fourth additional slot 587 is connected to an end of the fourth partition slot 567. The fourth additional slot 588 is connected to an end of the fourth partition slot 568. The two closed ends of the fourth additional slots 587 and 588 extend away from each other. The first additional slot 582 and the second additional slot 583 are both positioned between the first slot 551 and the second loop-shaped slot 570. The second additional slot 584 and the third additional slot 585 are both positioned between the second slot 552 and the second loop-shaped slot 570. The third additional slot 586 and the fourth additional slot 587 are both positioned between the third slot 553 and the second loop-shaped slot 570. The fourth additional slot 588 and the first additional slot 581 are both positioned between the fourth slot 554 and the second loop-shaped slot 570.

Each pair of the aforementioned crossing slots includes two separate relatively short arc-shaped slots. The first crossing slot 591 is connected to the first partition slot 561, and the first crossing slot 591 extends across a median portion of the first partition slot 561. The first crossing slot 592 is connected to the first partition slot 562, and the first crossing slot 592 extends across a median portion of the first partition slot 562. The second crossing slot 593 is connected to the second partition slot 563, and the second crossing slot 593 extends across a median portion of the second partition slot 563. The second crossing slot 594 is connected to the second partition slot 564, and the second crossing slot 594 extends across a median portion of the second partition slot 564. The third crossing slot 595 is connected to the third partition slot 565, and the third crossing slot 595 extends across a median portion of the third partition slot 565. The third crossing slot 596 is connected to the third partition slot 566, and the third crossing slot 596 extends across a median portion of the third partition slot 566. The fourth crossing slot 597 is connected to the fourth partition slot 567, and the fourth crossing slot 597 extends across a median portion of the fourth partition slot 567. The fourth crossing slot 598 is connected to the fourth partition slot 568, and the fourth crossing slot 598 extends across a median portion of the fourth partition slot 568. The first crossing slots 591 and 592, the second crossing slots 593 and 594, the third crossing slots 595 and 596, and the fourth crossing slots 597 and 598 are all inside a sixth circumference surrounded by the first slot 551, the second slot 552, the third slot 553, and the fourth slot 554. According to the practical measurement, the total size of the antenna structure 500 is reduced by using the above additional slots and crossing slots with meandering shapes (e.g., the area of the main radiation element 530 is about 20% smaller than that in FIG. 4). Other features of the antenna structure 500 of FIG. 5A and FIG. 5B are similar to those of the antenna structure 100 of FIG. 1A and FIG. 1B and those of the antenna structure 400 of FIG. 4A, FIGS. 4B and 4C. Therefore, these embodiments can achieve similar levels of performance.

Figure 6:
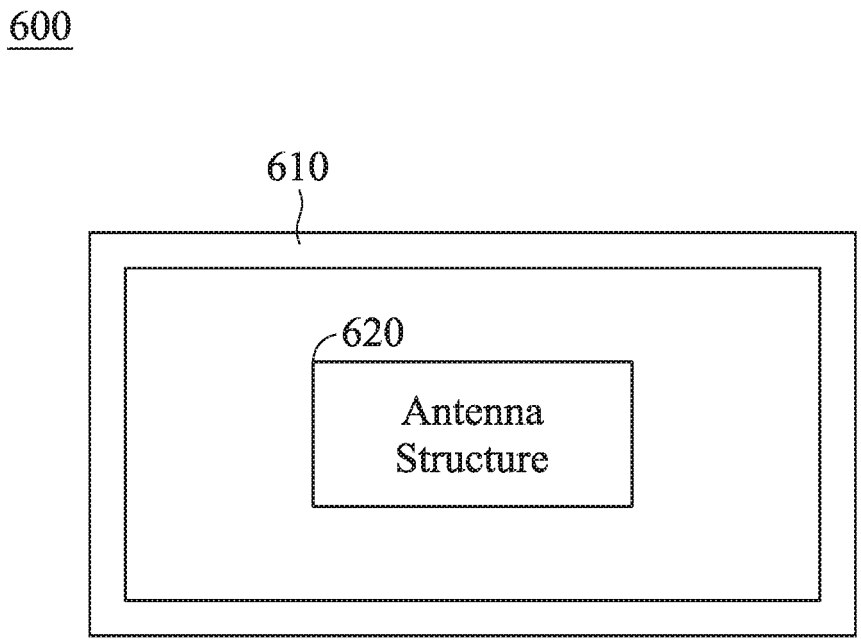
FIG. 6 is a diagram of an electronic device according to an embodiment of the invention.

FIG. 6 is a diagram of an electronic device 600 according to an embodiment of the invention. As shown in FIG. 6, the electronic device 600 at least includes a housing 610 and an antenna structure 620. The antenna structure 620 is disposed in the housing 610. For example, the electronic device 600 may be a wireless access point or a mobile device. The housing 610 is at least partially made of a nonconductive material, and therefore electromagnetic waves of the antenna structure 620 can be transmitted through it. For example, the antenna structure 620 may be the antenna structure 100 as described in the embodiment of FIG. 1A and FIG. 1B, the antenna structure 300 as described in the embodiment of FIG. 3, the antenna structure 400 as described in the embodiment of FIG. 4A, FIG. 4B, and FIG. 4C, or the antenna structure 500 as described in the embodiment of FIG. 5A and FIG. 5B, and its structure and function will not be illustrated again herein. It should be understood that the electronic device 600 may further include other components, such as a processor, a storage device, a speaker, a battery module, and/or a touch control panel although they are not displayed in FIG. 6.

The invention proposes a novel antenna structure and a novel electronic device. By appropriately opening slots on a main radiation element, the proposed antenna structure can provide good CP performance and sufficient operation bandwidth. Therefore, the invention is suitable for application in a variety of mobile communication devices.

Note that the above element sizes, element shapes, and frequency ranges are not limitations of the invention. An antenna designer can fine-tune these settings or values according to different requirements. It should be understood that the antenna structure and electronic device of the invention are not limited to the configurations of FIGS. 1-6. The invention may merely include any one or more features of any one or more embodiments of FIGS. 1-6. In other words, not all of the features displayed in the figures should be implemented in the antenna structure and electronic device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a dielectric substrate, having a first surface and a second surface opposite to each other;

a ground plane, disposed on the second surface of the dielectric substrate; and a main radiation element, disposed on the first surface of the dielectric substrate, wherein the main radiation element has a first loop-shaped slot and a second loop-shaped slot, and the first loop-shaped slot is positioned inside the second loop-shaped slot;

wherein the first loop-shaped slot comprises a first slot, a second slot, a third slot, a fourth slot, a pair of first partition slots, a pair of second partition slots, a pair of third partition slots, and a pair of fourth partition slots;

wherein the first slot, the second slot, the third slot, and the fourth slot are interleaved with the first partition slots, the second partition slots, the third partition slots, and the fourth partition slots;

wherein a first feeding point of the antenna structure is positioned between the first partition slots, and a second feeding point of the antenna structure is positioned between the second partition slots.

2. The antenna structure as claimed in claim 1, wherein the first slot, the second slot, the third slot, and the fourth slot are separate from each other, and are all arranged on a first circumference of a concentric circle.

3. The antenna structure as claimed in claim 2, wherein the first slot corresponds to a first central angle, the second slot corresponds to a second central angle, the third slot corresponds to a third central angle, and the fourth slot corresponds to a fourth central angle, and wherein the first central angle, the second central angle, the third central angle, and the fourth central angle are all from 70 to 89.5 degrees.

4. The antenna structure as claimed in claim 2, wherein the second loop-shaped slot is arranged on a second circumference of the concentric circle, and a length of the second circumference is longer than a length of the first circumference.

5. The antenna structure as claimed in claim 1, wherein one of the first partition slots is connected to the fourth slot, the other of the first partition slots is connected to the first slot, one of the second partition slots is connected to the first slot, the other of the second partition slots is connected to the second slot, one of the third partition slots is connected to the second slot, the other of the third partition slots is connected to the third slot, one of the fourth partition slots is connected to the third slot, and the other of the fourth partition slots is connected to the fourth slot.

6. The antenna structure as claimed in claim 1, wherein a first angle is formed between the first partition slots, a second angle is formed between the second partition slots, a third angle is formed between the third partition slots, and a fourth angle is formed between the fourth partition slots, and wherein the first angle, the second angle, the third angle, and the fourth angle are all from 0.5 to 20 degrees.

7. The antenna structure as claimed in claim 1, wherein the main radiation element is divided into a central radiation element, a loop-shaped radiation element, and a grounding radiation element by the first loop-shaped slot and the second loop-shaped slot, and wherein the central radiation element is at least partially coupled to the loop-shaped radiation element, and the loop-shaped radiation element is separate from the grounding radiation element.

8. The antenna structure as claimed in claim 7, wherein the central radiation element is positioned inside the first loop-shaped slot, the loop-shaped radiation element is positioned between the first loop-shaped slot and the second loop-shaped slot, and the grounding radiation element is positioned outside the second loop-shaped slot.

9. The antenna structure as claimed in claim 7, wherein the antenna structure covers a first frequency band and a second frequency band, wherein the first frequency band is from 1166 MHz to 1186 MHz or from 1217 MHz to 1237 MHz, and the second frequency band is from 1565 MHz to 1585 MHz, and wherein the loop-shaped radiation element is excited to generate the first frequency band, and the central radiation element is excited to generate the second frequency band.

10. The antenna structure as claimed in claim 9, wherein a distance between the second loop-shaped slot and the first loop-shaped slot is from $1/140$ to $1/40$ wavelength of the first frequency band.

11. The antenna structure as claimed in claim 9, wherein a width of the second loop-shaped slot and a width of the first loop-shaped slot are both from $1/350$ to $1/250$ wavelength of the first frequency band.

12. The antenna structure as claimed in claim 1, wherein the dielectric substrate comprises a first layer and a second layer parallel to each other, the first layer is adjacent to the first surface of the dielectric substrate, the second layer is adjacent to the second surface of the dielectric substrate, a first dielectric constant of the first layer is different from a second dielectric constant of the second layer.

13. The antenna structure as claimed in claim 12, wherein the first dielectric constant is at least 3 times the second dielectric constant.

14. The antenna structure as claimed in claim 1, wherein area of the ground plane is larger than area of the main radiation element, such that the main radiation element has a vertical projection on the second surface of the dielectric substrate and the whole vertical projection is inside the ground plane.

15. The antenna structure as claimed in claim 1, further comprising:

a parasitic radiation element, being floating and adjacent to the main radiation element.

16. The antenna structure as claimed in claim 15, wherein the parasitic radiation element has a central slot, a third loop-shaped slot, and a fourth loop-shaped slot, and wherein the third loop-shaped slot is positioned between the central slot and the fourth loop-shaped slot.

17. The antenna structure as claimed in claim 1, wherein the first partition slots are further respectively connected to a pair of first additional slots extending away from each other, the second partition slots are further respectively connected to a pair of second additional slots extending away from each other, the third partition slots are further respectively connected to a pair of third additional slots extending away from each other, and the fourth partition slots are further respectively connected to a pair of fourth additional slots extending away from each other.

18. The antenna structure as claimed in claim 1, wherein the first partition slots are further respectively connected to a pair of first crossing slots, the second partition slots are further respectively connected to a pair of second crossing slots, the third partition slots are further respectively connected to a pair of third crossing slots, and the fourth partition slots are further respectively connected to a pair of fourth crossing slots.

19. The antenna structure as claimed in claim 1, wherein a third feeding point of the antenna structure is positioned between the third partition slots, and a fourth feeding point of the antenna structure is positioned between the fourth partition slots.

20. An electronic device, comprising:

a housing; and an antenna structure, disposed in the housing, wherein the antenna structure comprises:

a dielectric substrate, having a first surface and a second surface opposite to each other;

a ground plane, disposed on the second surface of the dielectric substrate; and a main radiation element, disposed on the first surface of the dielectric substrate, wherein the main radiation element has a first loop-shaped slot and a second loop-shaped slot, and the first loop-shaped slot is positioned inside the second loop-shaped slot;

wherein the first loop-shaped slot comprises a first slot, a second slot, a third slot, a fourth slot, a pair of first partition slots, a pair of second partition slots, a pair of third partition slots, and a pair of fourth partition slots;

wherein the first slot, the second slot, the third slot, and the fourth slot are interleaved with the first partition slots, the second partition slots, the third partition slots, and the fourth partition slots;

wherein a first feeding point of the antenna structure is positioned between the first partition slots, and a second feeding point of the antenna structure is positioned between the second partition slots.

* * * * *